US008591248B2

(12) United States Patent
Pepe et al.

(10) Patent No.: US 8,591,248 B2
(45) Date of Patent: Nov. 26, 2013

(54) ELECTRICAL CONNECTOR WITH TERMINAL ARRAY

(75) Inventors: Paul John Pepe, Clemmons, NC (US); Ralph Sykes Martin, Mount Airy, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 253 days.

(21) Appl. No.: 13/010,533

(22) Filed: Jan. 20, 2011

(65) Prior Publication Data

US 2012/0190246 A1 Jul. 26, 2012

(51) Int. Cl.
*H01R 4/24* (2006.01)

(52) U.S. Cl.
USPC ..... 439/405; 439/891

(58) Field of Classification Search
USPC ..... 439/405, 404, 676, 891, 418
See application file for complete search history.

(56) References Cited

U.S. PATENT DOCUMENTS 4,458,970 A * 7/1984 Fourreau et al. ..... 439/176
4,804,332 A * 2/1989 Pirc ..... 439/620.09
5,061,198 A * 10/1991 Manabe et al. ..... 439/293
5,536,182 A * 7/1996 Atoh et al. ..... 439/404
5,556,307 A * 9/1996 Johnston ..... 439/676
5,905,637 A 5/1999 Su
5,951,340 A * 9/1999 Mueller et al. ..... 439/891
5,967,801 A 10/1999 Martin et al.
5,971,792 A * 10/1999 Lin ..... 439/404
5,971,812 A 10/1999 Martin
6,007,368 A 12/1999 Lorenz et al.
6,010,353 A 1/2000 Ensz et al.
6,062,895 A * 5/2000 Lin et al. ..... 439/404
6,102,730 A * 8/2000 Kjeldahl et al. ..... 439/405
6,113,400 A 9/2000 Martin et al.
6,116,943 A 9/2000 Ferrill et al.
6,193,526 B1 2/2001 Milner et al.
6,193,542 B1 2/2001 Marowsky et al.
6,244,906 B1 6/2001 Hashim et al.
6,270,372 B1 * 8/2001 Jenner et al. ..... 439/405
6,283,768 B1 9/2001 Van Naarden
6,361,354 B1 * 3/2002 Viklund et al. ..... 439/418
6,371,793 B1 4/2002 Doorhy et al.
6,379,174 B1 * 4/2002 Siemon et al. ..... 439/404
6,394,835 B1 5/2002 Milner et al.
6,402,559 B1 6/2002 Marowsky et al.
6,409,535 B1 6/2002 Marowsky et al.
6,447,326 B1 * 9/2002 Teach et al. ..... 439/460
6,506,077 B2 1/2003 Nagel
6,682,363 B1 1/2004 Chang
6,692,307 B2 2/2004 Laes
RE38,519 E 5/2004 Doorhy et al.
6,799,989 B2 10/2004 Doorhy et al.
6,811,445 B2 11/2004 Caveney et al.
6,918,782 B2 7/2005 Foster (Continued)

*Primary Examiner* — Neil Abrams
(74) *Attorney, Agent, or Firm* — Merchant & Gould P.C.

(57) ABSTRACT

An electrical connector is provided. The connector includes a housing having a wire end and a mating end. A terminal array extends between the wire end and the mating end of the housing. The terminal array has second terminals and first terminals. Each of the second terminals and the first terminals has a wire contact positioned at the wire end of the housing and a mating contact positioned at the mating end of the housing. The wire contact of each second terminal is positioned closer to the wire end of the housing than the wire contact of each first terminal. The mating contacts of the second terminals are positioned adjacent the mating contacts of the first terminals.

26 Claims, 15 Drawing Sheets

(56) References Cited

U.S. PATENT DOCUMENTS

| | | | | |
|---|---|---|---|---|
| 6,923,672 | B1 * | 8/2005 | Chen | 439/404 |
| 7,018,241 | B2 | 3/2006 | Caveney et al. | |
| 7,033,219 | B2 | 4/2006 | Gordon et al. | |
| 7,114,985 | B2 | 10/2006 | Doorhy et al. | |
| 7,168,994 | B2 | 1/2007 | Caveney et al. | |
| 7,201,618 | B2 | 4/2007 | Ellis et al. | |
| 7,220,149 | B2 | 5/2007 | Pharney | |
| 7,297,013 | B2 | 11/2007 | Caveney et al. | |
| 7,374,458 | B2 | 5/2008 | Caveney et al. | |
| 7,381,097 | B2 | 6/2008 | Ellis et al. | |
| 7,425,159 | B2 | 9/2008 | Lin | |
| 7,474,737 | B2 | 1/2009 | Crudele et al. | |
| 7,534,128 | B2 | 5/2009 | Caveney et al. | |
| 7,556,536 | B2 | 7/2009 | Caveney et al. | |
| 7,604,515 | B2 | 10/2009 | Siemon et al. | |
| 7,651,380 | B2 | 1/2010 | Below et al. | |
| 7,695,303 | B2 | 4/2010 | Chen et al. | |
| 7,711,093 | B2 | 5/2010 | Crudele et al. | |
| 7,713,094 | B1 | 5/2010 | Sparrowhawk | |
| 7,727,025 | B2 | 6/2010 | Fogg et al. | |
| 7,857,635 | B2 | 12/2010 | Goodrich et al. | |
| 7,874,849 | B2 * | 1/2011 | Sticker et al. | 439/76.1 |
| 7,883,376 | B2 * | 2/2011 | Milette et al. | 439/676 |
| 7,909,656 | B1 | 3/2011 | Erickson et al. | |
| 7,972,183 | B1 | 7/2011 | Lin | |
| 7,980,899 | B2 | 7/2011 | Siemon et al. | |
| 8,002,571 | B2 * | 8/2011 | Hogue et al. | 439/404 |
| 8,016,621 | B2 | 9/2011 | Bopp et al. | |
| 8,038,482 | B2 | 10/2011 | Erickson et al. | |
| 8,043,124 | B2 | 10/2011 | Caveney et al. | |
| 8,118,610 | B2 * | 2/2012 | Neumetzler et al. | 439/403 |
| 8,197,286 | B2 | 6/2012 | Larsen et al. | |
| 8,235,757 | B2 | 8/2012 | Brear | |
| 8,257,117 | B2 * | 9/2012 | Pepe et al. | 439/676 |
| 8,298,922 | B2 | 10/2012 | Schumann et al. | |
| 2012/0094525 | A1 | 4/2012 | Maranto et al. | |
| 2012/0100744 | A1 | 4/2012 | Bolouri-Saransar et al. | |
| 2012/0190248 | A1 | 7/2012 | Bopp et al. | |

* cited by examiner

ELECTRICAL CONNECTOR WITH TERMINAL ARRAY

FIELD OF THE INVENTION

The subject matter described herein relates to an electrical connector and, more particularly, to an electrical connector having a terminal array.

BACKGROUND OF THE INVENTION

Electrical connectors are commonly used to couple a cable to a corresponding jack, cable, electrical device or the like. The electrical connector includes wire terminals positioned at a wire end of the connector. The wire terminals are configured to terminate twisted pairs of the cable and are generally housed in a load bar that is positioned within the connector. Specifically, each wire of a twisted pair is separated and joined to a terminal in the load bar. Contacts are coupled to the load bar at a mating end of the connector. The load bar carries electrical signals, for example, power and/or data signals, from the cable to the contacts. The contacts are configured to mate with corresponding contacts of the jack, cable, electrical device or the like. Accordingly, the connector carries the electrical signals from the cable to the corresponding jack, cable, electrical device or the like.

However, conventional electrical connectors are not without their disadvantages. In some electrical connectors wire terminals are positioned in close proximity to one another. Accordingly, electromagnetic crosstalk may be experienced between the wire terminals. Specifically, the wire terminals may experience crosstalk between differential pairs of the cable. Excessive crosstalk may impair the performance of the connector. For example, the crosstalk may reduce a speed at which the connector is capable of carrying the electrical signals. The crosstalk may also interfere with the electrical signals, thereby rendering the connector inoperable.

Additionally, conventional connectors typically include limited space for coupling wires thereto. For example, each wire of a cable must be joined to the connector within the confines of the load bar. The load bar may not be capable of accommodating all sizes of wire. As such, the connector is limited to use with cables having wire that is capable of joining to the load bar.

A need remains for an electrical connector that controls crosstalk between the differential pairs of a cable. Another need remains for an electrical connector that is capable of accommodating different size wires.

SUMMARY OF THE INVENTION

In one embodiment, an electrical connector is provided. The connector includes a housing having a wire end and a mating end. The housing has a bottom extending between the wire end and the mating end. A terminal array extends between the wire end and the mating end of the housing. The terminal array has second terminals and first terminals. The second terminals and the first terminals have a wire end and a mating end. The mating ends of the second terminals are aligned with the mating ends of the first terminals. The wire ends of the second terminals are positioned closer to the wire end of the housing than the wire ends of the first terminals. A wire contact is positioned at the wire end of each of the second terminals and the first terminals. The wire contact of each first terminal is positioned a distance from the bottom of the housing. The wire contact of each second terminal is positioned a distance from the bottom of the housing that is different than the distance of the wire contacts of the first terminals. Mating contacts are positioned at the mating end of the second terminals and the first terminals. The mating contacts of the second terminals are aligned and alternate with the mating contacts of the first terminals.

In another embodiment, a terminal array for an electrical connector is provided. The terminal array has a length and a height. The terminal array has second terminals and first terminals. Each of the second terminals and the first terminals has a wire contact and a mating contact. The wire contact of each second terminal is offset from wire contact of each first terminal along the length of the terminal array. The wire contact of each second terminal is offset from the wire contact of each first terminal along the height of the terminal array.

In another embodiment, an electrical connector is provided. The connector includes a housing having a wire end and a mating end. A bottom extends between the wire end and the mating end. A terminal array extends between the wire end and the mating end of the housing. The terminal array has second terminals and first terminals. The second terminals and the first terminals have a wire end and a mating end. The mating ends of the second terminals are aligned with the mating ends of the first terminals. The wire ends of the second terminals are positioned closer to the wire end of the housing than the wire ends of the first terminals. A wire contact is positioned at the wire end of each of the second terminals and the first terminals. The wire contact of each first terminal is stepped up a distance from the wire contact of each second terminal with respect to the bottom of the housing. Mating contacts are positioned at the mating end of the second terminals and the first terminals. The mating contacts of the second terminals are aligned and alternate with the mating contacts of the first terminals.

DETAILED DESCRIPTION OF THE DRAWINGS

The foregoing summary, as well as the following detailed description of certain embodiments will be better understood when read in conjunction with the appended drawings. As used herein, an element or step recited in the singular and proceeded with the word "a" or "an" should be understood as not excluding plural of said elements or steps, unless such exclusion is explicitly stated. Furthermore, references to "one embodiment" are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

Figure 1:
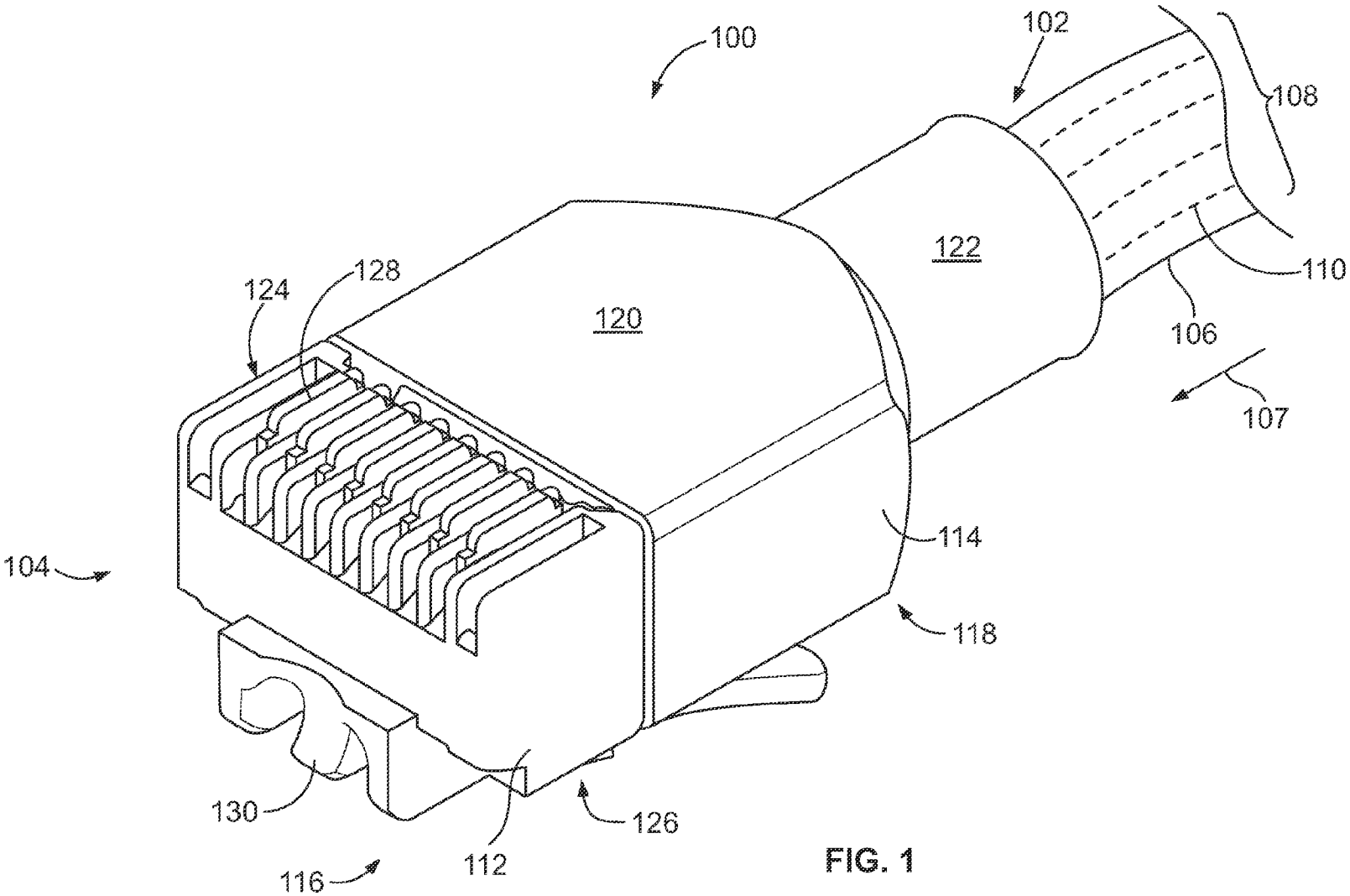
FIG. 1 is a top perspective view of an electrical connector formed in accordance with an embodiment.

FIG. 1 illustrates an electrical connector 100 formed in accordance with an embodiment. In an exemplary embodiment, the electrical connector is a RJ-45 plug. However, the embodiments described herein may be used with any suitable connector, receptacle or plug. The electrical connector 100 includes a wire end 102 and a mating end 104. The wire end 102 is configured to be joined to a cable 106. The cable 106 is inserted into the wire end 102 of the connector 100 in a loading direction 107. The cable 106 includes a conductor 108 having wires 110 arranged in twisted pairs. In one embodiment, the wires 110 are arranged in differential pairs which enable signal transmission via signals on separate wires that are approximately 180 degrees out of phase with each other. The wires 110 of the cable 106 are configured to be electrically coupled to the connector 100. The mating end 104 of the connector 100 is configured to join a corresponding connector (not shown).

The connector 100 includes a housing 112 and a shield 114. The housing 112 may have a size similar to that of a Cat.-6 housing. Cat.-6 cable is the standard for Gigabit Ethernet and other network protocols that are backward compatible with the Category 5/5e and Category 3 cable standards. Cat.-6 features more stringent specifications for crosstalk and system noise. The Cat.-6 cable standard provides performance of up to 250 MHz and is suitable for 10BASE-T, 100BASE-TX (Fast Ethernet), 1000BASE-T/1000BASE-TX (Gigabit Ethernet) and 10GBASE-T (10-Gigabit Ethernet). Cat.-6 cable has a reduced maximum length when used for 10GBASE-T, is characterized to 500 MHz and has improved alien crosstalk characteristics, allowing 10GBASE-T to be run for the same distance as previous protocols.

In an exemplary embodiment, the housing 112 is formed from polycarbonate. Alternatively, the housing 112 may be formed from any suitable non-conductive material. The housing 112 has a mating end 116 and a wire end 118. The shield 114 is joined to the wire end 118 of the housing 112. The shield 114 includes a housing portion 120 and a cable portion 122. The housing portion 120 is joined to the wire end 118 of the housing 112. The cable portion 122 extends from the housing portion 120. The cable portion 122 is joined to the cable 106. The shield 114 protects the connector 100 from electro-magnetic interference.

The housing 112 includes a top 124 and a bottom 126. The top 124 of the housing 112 includes a plurality of mating contacts 128. The mating contacts 128 are configured to electrically couple to contacts positioned on the corresponding connector. The mating contacts 128 create an electrical connection between the connector 100 and the corresponding connector. The mating contacts 128 may be formed from phos-bronze. The mating contacts 128 may include a gold plated surface. Alternatively, the mating contacts 128 may be formed from any suitable conductive material and/or have any suitable conductive plating.

The bottom 126 of the connector 100 includes a latch 130. The latch 130 is configured to engage a corresponding mechanism on the corresponding connector. The latch 130 secures the connector 100 to the corresponding connector. In an alternative embodiment, the connector 100 and the corresponding connector may include any suitable corresponding engagement mechanisms to join the connector 100 to the corresponding connector.

Figure 2:
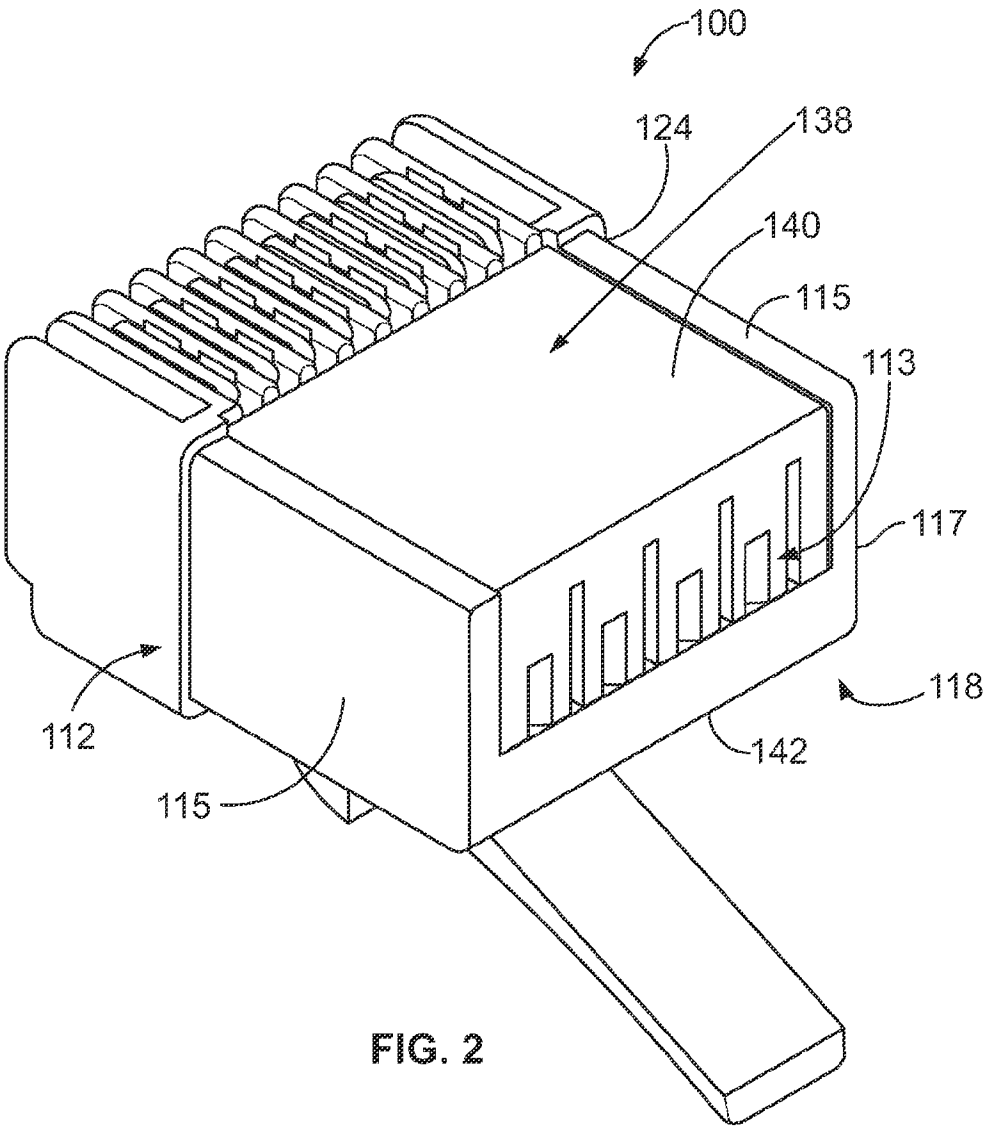
FIG. 2 is a top perspective view of the electrical connector shown in FIG. 1 and having the shield removed.

FIG. 2 illustrates the electrical connector 100 having the shield 114 removed. The housing 112 includes sidewalls 115 extending from the wire end 118 of the housing 112. The wire end 118 of the housing 112 includes a cavity 113 defined by the sidewalls 115. The cavity 113 includes a bottom surface 117. A retention housing 138 is positioned within the cavity 113. The retention housing 138 extends between the sidewalls 115 of the housing 112. The retention housing 138 includes a top 140 and a bottom 142. The bottom 142 of the retention housing 138 rests on the bottom surface 117 of the cavity 113. The retention housing 138 extends from the bottom surface 117 of the cavity 113 to the top 124 of the housing 112. The top 140 of the retention housing 138 is substantially flush with the top 124 of the housing 112. Alternatively, the top 140 of the retention housing 138 may be recessed with respect to the top 124 of the housing 112 or extend beyond the top 124 of the housing 112. The retention housing 138 is configured to retain the electrical components within the housing 112.

Figure 3:
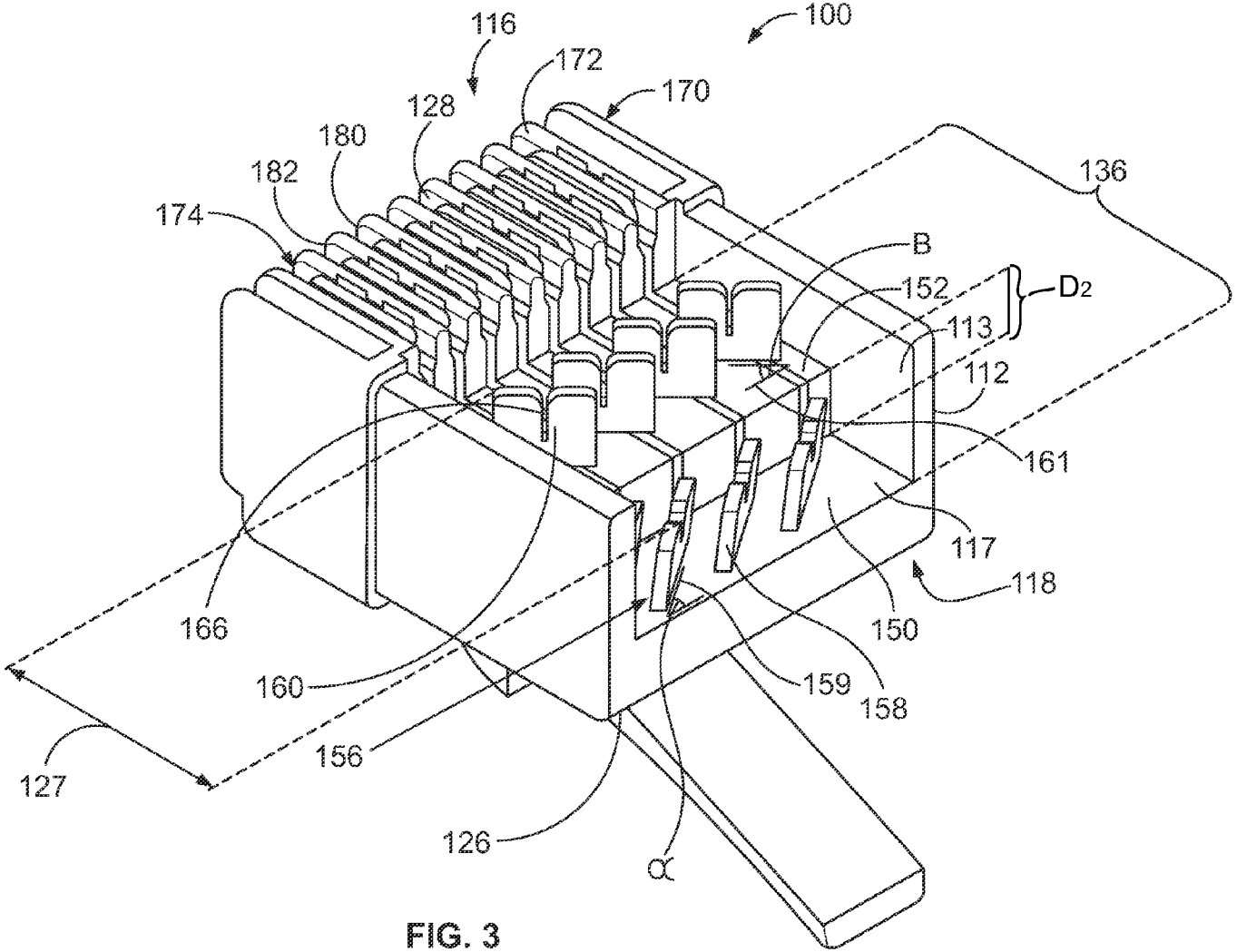
FIG. 3 a top perspective view of the electrical connector shown in FIG. 2 and having the retention housing removed.

FIG. 3 illustrates the connector 100 with the retention housing 138 removed. The wire end 118 of the housing 112 includes a wire contact area 136 extending along the bottom surface 117 of the cavity 113. The wire contact area 136 is configured to be covered by the retention housing 138 when the retention housing 138 is positioned in the housing 112. The wire contact area 136 includes a front mounting surface 150 and a rear mounting surface 152. The front mounting surface 150 is positioned closer to the wire end 118 of the housing 112 than the rear mounting surface 152. The front mounting surface 150 is positioned proximate to the wire end 118 of the housing 112. The rear mounting surface 152 is positioned between the front mounting surface 150 and the mating end 116 of the housing 112. The front mounting surface 150 is positioned proximate to the bottom 126 of the housing 112. The rear mounting surface 152 is stepped up vertically a distance $D_2$ from the front mounting surface 150. The rear mounting surface 152 is positioned between the front mounting surface 150 and the top 124 of the housing 112. The rear mounting surface 152 and the front mounting surface 150 are offset to provide a predetermined tuning for the connector 100. In an alternative embodiment, each of the front mounting surface 150 and the rear mounting surface 152 may be aligned within the same plane.

The wire contact area 136 is configured with a plurality of wire contacts 156. The wire contacts 156 are configured as blades. The wire contacts 156 may be formed from phos-bronze and/or include a matte-tin over nickel plating. Optionally, the wire contacts 156 may be formed from any suitable conductive material. Front wire contacts 158 are positioned in the front mounting surface 150 and rear wire contacts 160 are positioned in the rear mounting surface 152. The front wire contacts 158 are positioned closer to the bottom 126 of the housing than the rear wire contacts 160. The rear wire contacts 160 are stepped up a distance 127 from the front wire contacts 158. The front wire contacts 158 are positioned closer to the wire end 118 of the housing 112 than the rear wire contacts 160.

The front wire contacts 158 extend in a plane 159. The plane 159 is oriented non-orthogonally with respect to the wire end 118 of the housing 112. The plane 159 is oriented non-orthogonally with respect to the loading direction 107 of the cable 106. The front wire contacts 158 are arranged at an angle $\alpha$ with respect to the wire end 118 of the housing 112. In one embodiment, the angle $\alpha$ may be 45 degrees.

The rear wire contacts 160 extend in a plane 161. The plane 161 is oriented non-orthogonally with respect to the wire end 118 of the housing 112. The plane 161 is oriented non-orthogonally with respect to the loading direction 107 of the cable 106. The plane 161 is oriented non-parallel with respect to the plane 159 of the front wire contacts 158. The rear wire contacts 160 are arranged at an angle $\beta$ with respect to the wire end 118 of the housing 112. In one embodiment, the angle $\beta$ may be 45 degrees. The angle $\alpha$ is opposite the angle $\beta$. In an exemplary embodiment, the front wire contacts 158 are arranged 90 degrees with respect to the rear wire contacts 160. In another embodiment, the front wire contacts 158 and the rear wire contacts 160 may be arranged at any angle with respect to one another. Optionally, the front wire contacts 158 may each be arranged at different angles $\alpha$ and the rear wire contacts 160 may each be arranged at different angles $\beta$. The angles $\alpha$ and $\beta$ are configured to provide predetermined tuning for the connector 100.

The wire contacts 156 include a slot 166. The slot 166 is configured to receive a wire 110 (shown in FIG. 1) of the cable 106 (shown in FIG. 1). The slot 166 may be configured to receive a stranded and/or solid wire. In one embodiment, the wire contacts 156 may include any number of slots 166 to receive any number of wires 110. The wire 110 is retained within the slot 166 through an interference fit. Optionally, the wire 110 may be soldered to the wire contact 156 after the wire 110 is inserted into the slot 166. A first wire of a differential pair is configured to be joined to a front wire contact 158. A second wire of the differential pair is configured to be joined to a rear wire contact 160. The wires of the differential pairs of the cable 106 are separated between the front wire contacts 158 and the rear wire contacts 160. Optionally, each wire 110 of a differential pair may be joined to front wire contacts 158 or rear wire contacts 160.

The housing 112 includes a contact holder 170 positioned proximate to the mating end 116 of the housing 112. The contact holder 170 includes partitions 172 and slots 174 formed between the partitions 172. The mating contacts 128 are positioned within the slots 174. The mating contacts 128 extend toward the top 124 of the housing 112. The mating contacts 128 are electrically coupled to the wire contacts 156. The mating contacts 128 include front mating contacts 180 and rear mating contacts 182. The front mating contacts 180 are electrically joined to the front wire contacts 158. The rear mating contacts 182 are electrically joined to the rear wire contacts 160. The terms "front" and "rear" as used with respect to the mating contacts 128 designates the wire contact 156 to which the mating contact 128 is joined. The terms "front" and "rear" as used with respect to the mating contacts 128 are not used to designate a position of the mating contacts 128. The mating contacts 128 are arranged in parallel. In another embodiment, the mating contacts 128 may be offset from one another. The front mating contacts 180 are positioned adjacent to and alternate with the rear mating contacts 182. The front mating contacts 180 and the rear mating contacts 182 are alternated to achieve a predetermined tuning for the connector 100. In another embodiment, the front mating contacts 180 and the rear mating contacts 182 may be arranged in any order that provides a predetermined performance of the connector.

Figure 4:
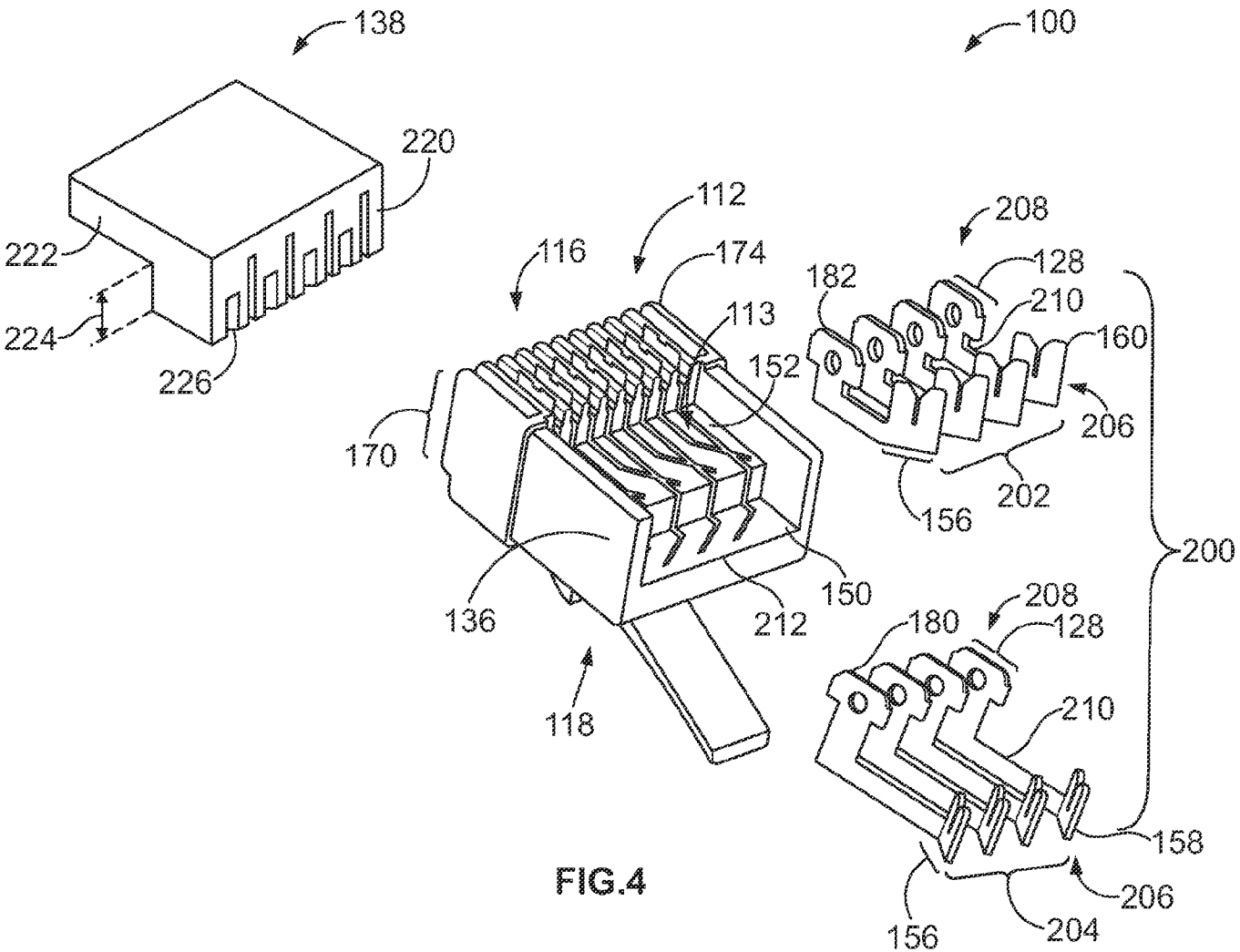
FIG. 4 is an exploded view of the connector shown in FIG. 2.

FIG. 4 illustrates an exploded view of the connector 100. The connector 100 includes terminals 200. The terminals 200 include an array of first terminals 202 and an array of second terminals 204. The terminals 200 each include a wire end 206 and a mating end 208. An arm 210 extends between the wire end 206 and the mating end 208. A mating contact 128 is joined to the mating end 208 of each terminal 200. A wire contact 156 is joined to the wire end 206 of each terminal 200. The arm 210 of each terminal 200 extends between the mating contact 128 and the wire contact 156. In an exemplary embodiment, the first terminals 202 include rear mating contacts 182 and rear wire contacts 160. In an exemplary embodiment, the second terminals 204 include front mating contacts 180 and front wire contacts 158.

The terminals 200 are configured to be positioned within the housing 112. The housing 112 includes slots 212 that extend along the wire contact area 136 of the housing 112. The slots 212 extend between the wire end 118 and the mating end 116 of the housing 112. The slots 212 are aligned with and in communication with the slots 174 formed in the contact holder 170. The first terminals 202 are positioned within the slots 212 such that the rear wire contacts 160 are positioned on the rear mounting surface 152. The second terminals 204 are positioned within the slots 212 such that the front wire contacts 158 are positioned on the front mounting surface 150. The front mating contacts 180 and the rear mating contacts 182 are configured to be positioned with the slots 174 of the contact holder 170.

The retention housing 138 is configured to be positioned within the cavity 113 of the housing 112. The retention housing 138 includes a front portion 220 and a rear portion 222. The front portion 220 is configured to be positioned over the front mounting surface 150 of the housing 112. The rear portion 222 is configured to be positioned over the rear mounting surface 152 of the housing 112. The rear portion 222 is stepped up from the front portion 220 a distance 224. The distance 224 corresponds to the distance $D_2$ between the front mounting surface 150 and the rear mounting surface 152 so that the retention housing 138 rests on the wire contact area 136 of the housing 112.

The retention housing 138 includes slots 226 extending therethrough. The slots 226 are configured to be positioned over the terminals 200 when the retention housing 138 is positioned within the housing 112. The retention housing 138 holds the terminals 200 in position to provide stability to the terminals 200 within the housing 112.

Figure 5:
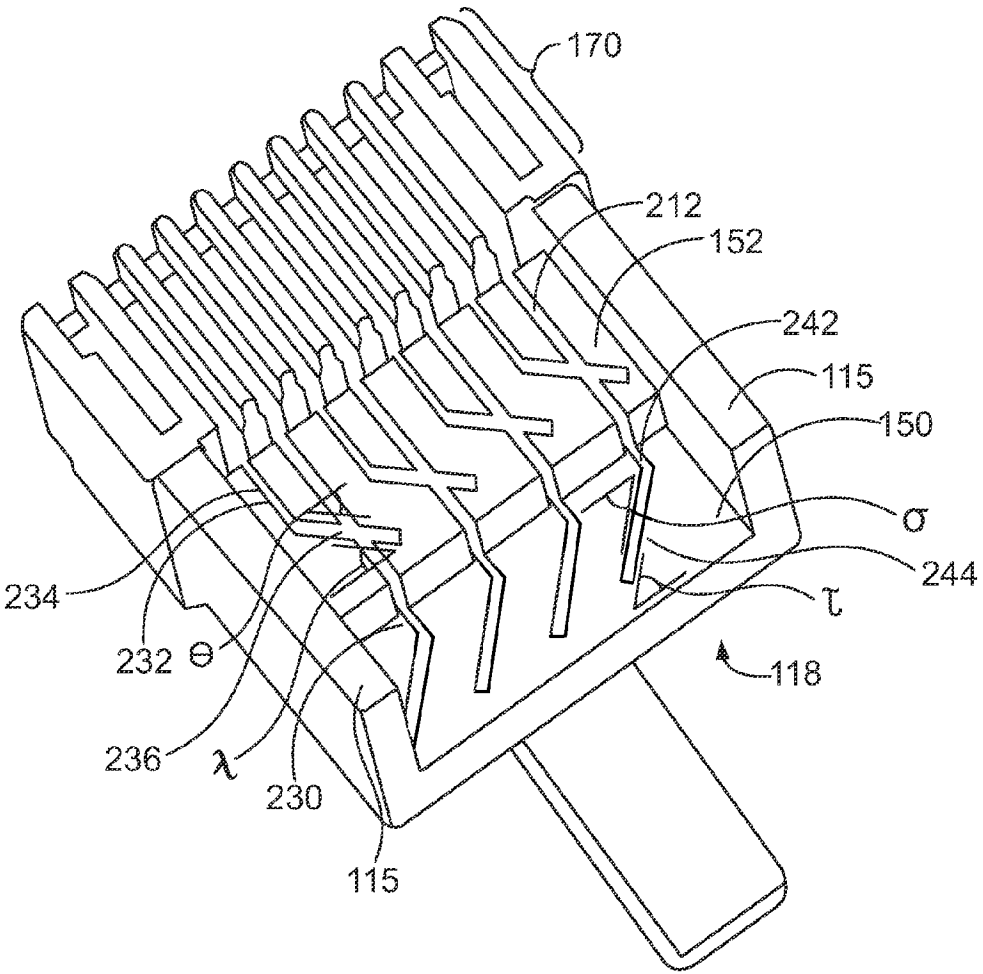
FIG. 5 is a top perspective view of a connector housing formed in accordance with an embodiment.

FIG. 5 illustrates the housing 112. The slots 212 extend between the wire end 118 and the mating end 116 of the housing 112. The slots 212 include long slots 230 and short slots 232. The short slots 232 extend from beneath the contact holder 170 along the rear mounting surface 152. The short slots 232 are configured to receive and retain the first terminals 202. The long slots 230 extend from beneath the contact holder 170 along the rear mounting surface 152 and the front mounting surface 150. The long slots 230 are configured to receive and retain the second terminals 204.

The short slots 232 include and arm portion 234 and a contact portion 236. The arm portion 234 extends from beneath the contact holder 170 toward the wire end 118 of the housing 112. The arm portion 234 extends substantially parallel to the sidewalls 115 of the housing 112. Optionally, the arm portion 234 may extend at an angle with respect to the sidewalls 115 of the housing 112. The contact portion 236 extends at an angle $\theta$ from the arm portion 234. The contact portion 236 is oriented at an angle λ, with respect to the wire end 118 of the housing 112. The angle λ, corresponds to the angle β of the rear wire contacts 160 with respect to the wire end 118 of the housing 112. The arm portion 234 of the slot is configured to receive the arm 210 of the first terminal 202. The contact portion 236 is configured to receive the rear wire contact 160 joined to the arm 210 of the first terminal 202. The rear mating contact 182 that is joined to the arm 210 of the first terminal 202 is configured to be positioned within a section of the arm portion 234 that extends beneath the contact holder 170. The rear mating contact 182 is retained with the contact holder 170.

The long slots 230 include and arm portion 242 and a contact portion 244. The arm portion 242 extends from beneath the contact holder 170 toward the wire end 118 of the housing 112. The arm portion 242 extends substantially parallel to the sidewalls 115 of the housing 112. Optionally, the arm portion 242 may extend at an angle with respect to the sidewalls 115 of the housing 112. The contact portion 244 extends at an angle σ from the arm portion 242. The contact portion 244 is oriented at an angle τ with respect to the wire end 118 of the housing 112. The angle τ corresponds to the angle α of the front wire contacts 158 with respect to the wire end 118 of the housing 112. The arm portion 242 of the slot is configured to receive the arm 210 of the second terminal 204. The contact portion 244 is configured to receive the front wire contact 158 joined to the arm 210 of the second terminal 204. The front mating contact 180 that is joined to the arm 210 of the second terminal 204 is configured to be positioned within a section of the arm portion 242 that extends beneath the contact holder 170. The front mating contact 180 is retained with the contact holder 170.

Figure 6:
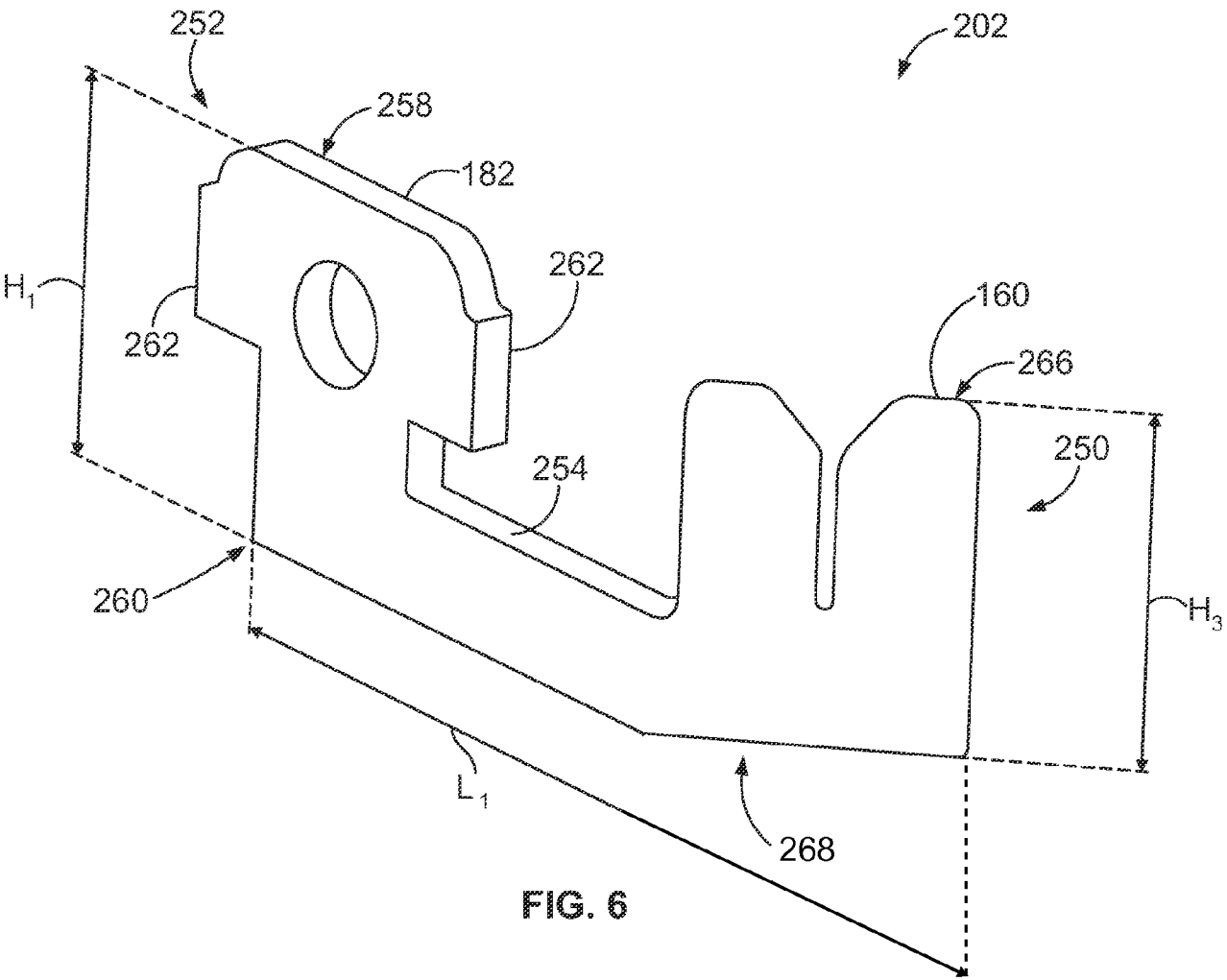
FIG. 6 is a side perspective view of a first terminal formed in accordance with an embodiment.

FIG. 6 illustrates a first terminal 202. The first terminal 202 includes a short wire end 250 and a short mating end 252. A short arm 254 extends between the short wire end 250 and the short mating end 252. The short arm 254 has a length $L_1$ defined between the short wire end 250 and the short mating end 252. A rear mating contact 182 is joined to the short mating end 252 of the first terminal 202. The rear mating contact 182 includes a top 258 and a bottom 260. The rear mating contact 182 has a height $H_1$ defined between the top 258 and the bottom 260 of the rear mating contact 182. The top 258 includes flanges 262 that are configured to mate with a contact of a corresponding connector. A rear wire contact 160 is joined to the short wire end 250 of the first terminal 202. The rear wire contact 160 has a top 266 and a bottom 268. The rear wire contact 160 has a height $H_3$ defined between the top 266 and the bottom 268.

Figure 7:
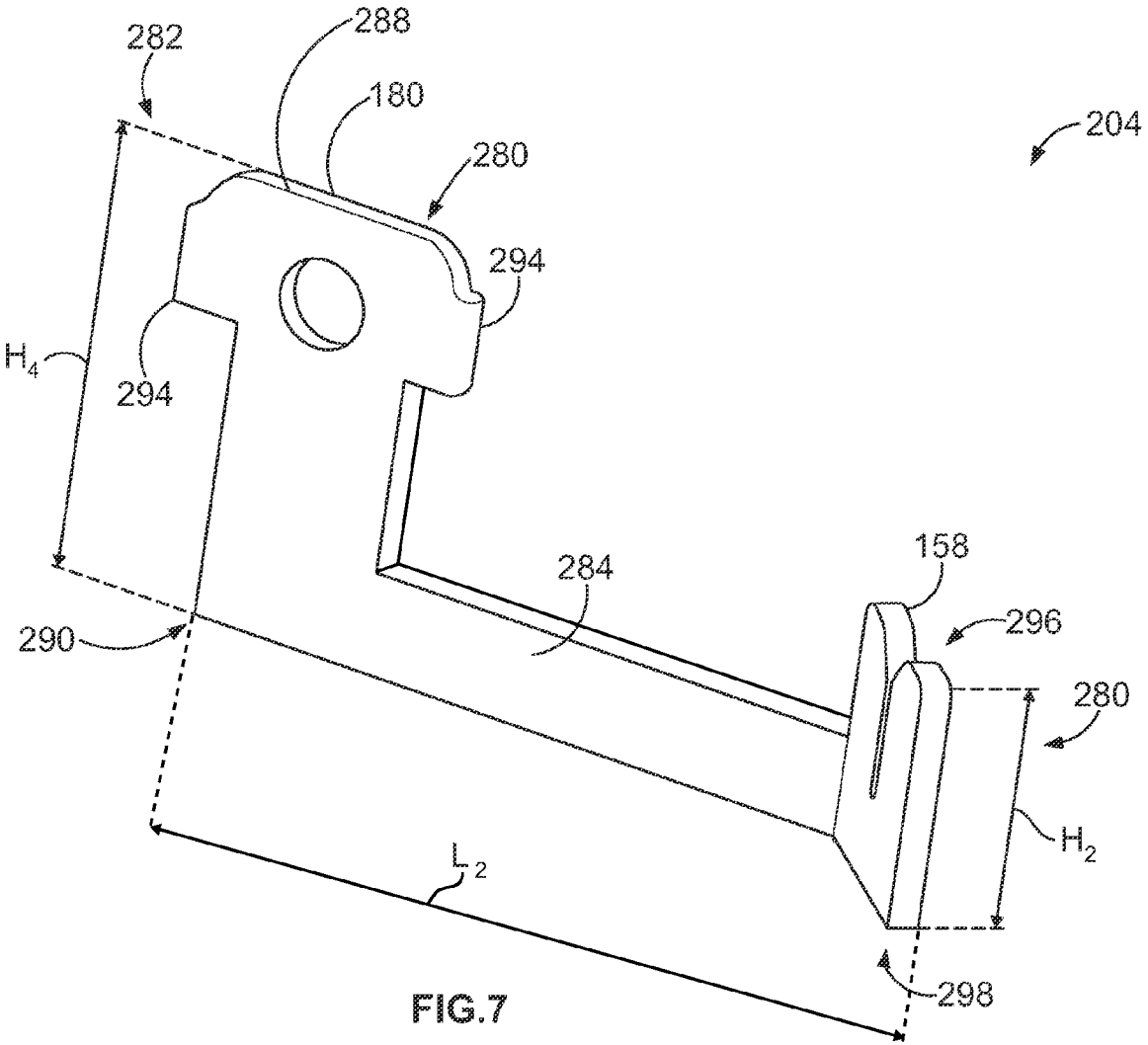
FIG. 7 is a side perspective view of a second terminal formed in accordance with an embodiment.

FIG. 7 illustrates a second terminal 204. The second terminal 204 includes a long wire end 280 and a long mating end 282. A long arm 284 extends between the long wire end 280 and the long mating end 282. The long arm 284 has a length $L_2$ defined between the long wire end 280 and the long mating end 282. The length $L_2$ of the long arm 284 is greater than the length $L_1$ of the short arm 254 (shown in FIG. 6). The long mating 282 of the second terminal 204 is configured to be aligned with the short mating 252 of the first terminal 202 when the second terminal 204 and the first terminal 202 are inserted in to the housing 112. The long wire end 280 of the second terminal 204 is configured to be positioned closer to the wire end 102 of the housing 112 than the short wire end 250 of the first terminal 202 when the second terminal 204 and the first terminal 202 are inserted into the housing 112.

A front mating contact 180 in joined to the long mating end 282 of the second terminal 204. The front mating contact 180 has a top 288 and a bottom 290. The front mating contact 180 has a height $H_4$ defined between the top 288 and the bottom 290. The height $H_4$ of the front mating contact 180 is greater than the height $H_1$ of the rear mating contact 182 (shown in FIG. 6). Optionally, the height $H_4$ of the front mating contact 180 may be the same or less than the height $H_1$ of the rear mating contact 182. The front mating contact 180 includes flanges 294 that are configured to mates with a contact of a corresponding connector.

A front wire contact 158 is joined to the long wire end 280 of the second terminal 204. The front wire contact 158 has a top 296 and a bottom 298. The front wire contact 158 has a height $H_2$ defined between the top 296 and the bottom 298. The height $H_2$ of the front wire contact 158 is equal to the height $H_3$ of the rear wire contact 160 (shown in FIG. 6). Optionally, the height $H_2$ of the front wire contact 158 may be less than or greater than the height $H_3$ of the rear wire contact 160.

Figure 8:
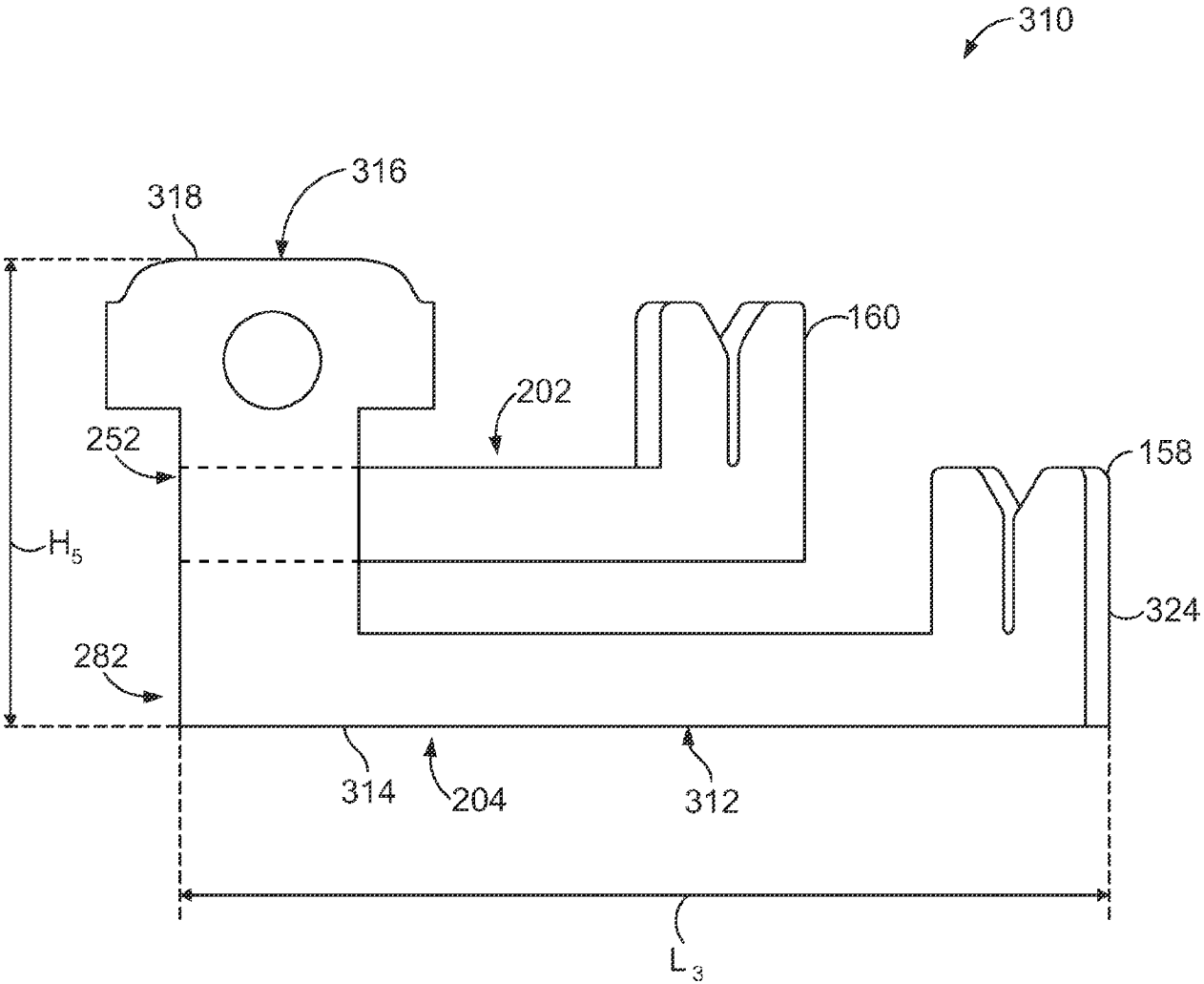
FIG. 8 is a side view of a terminal array formed in accordance with an embodiment.

FIG. 8 illustrates a terminal array 310 formed in accordance with an embodiment. The terminal array 310 includes second terminals 204 and first terminals 202. The long mating end 282 of the second terminal 204 is aligned with the short mating end 252 of the first terminal 202. The long wire end 280 of the second terminal 204 is offset from the short wire end 250 of the first terminal 202. The terminal array 310 includes a bottom 312 defined by a bottom 314 of the second terminals 204. The terminal array 310 includes a top 316 defined by a top 318 of the mating contacts 128. The terminal array 310 has a height $H_5$ defined between the top 316 and the bottom 312. The terminal array 310 has a length $L_3$ defined between a long mating end 282 of the second terminal 204 and an end 324 of the front wire contact 158.

The second terminal 204 and the first terminal 202 are offset with respect to the height $H_5$ of the terminal array 310. The rear wire contact 160 and the front wire contact 158 are offset with respect to the height $H_5$ of the terminal array 310. The rear wire contact 160 and the front wire contact 158 are offset with respect to the length $L_3$ of the terminal array 310. The mating contacts 128 are aligned within the terminal array 310. Optionally, the mating contacts 128 may be offset with respect to the length $L_3$ of the terminal array 310.

Figure 9:
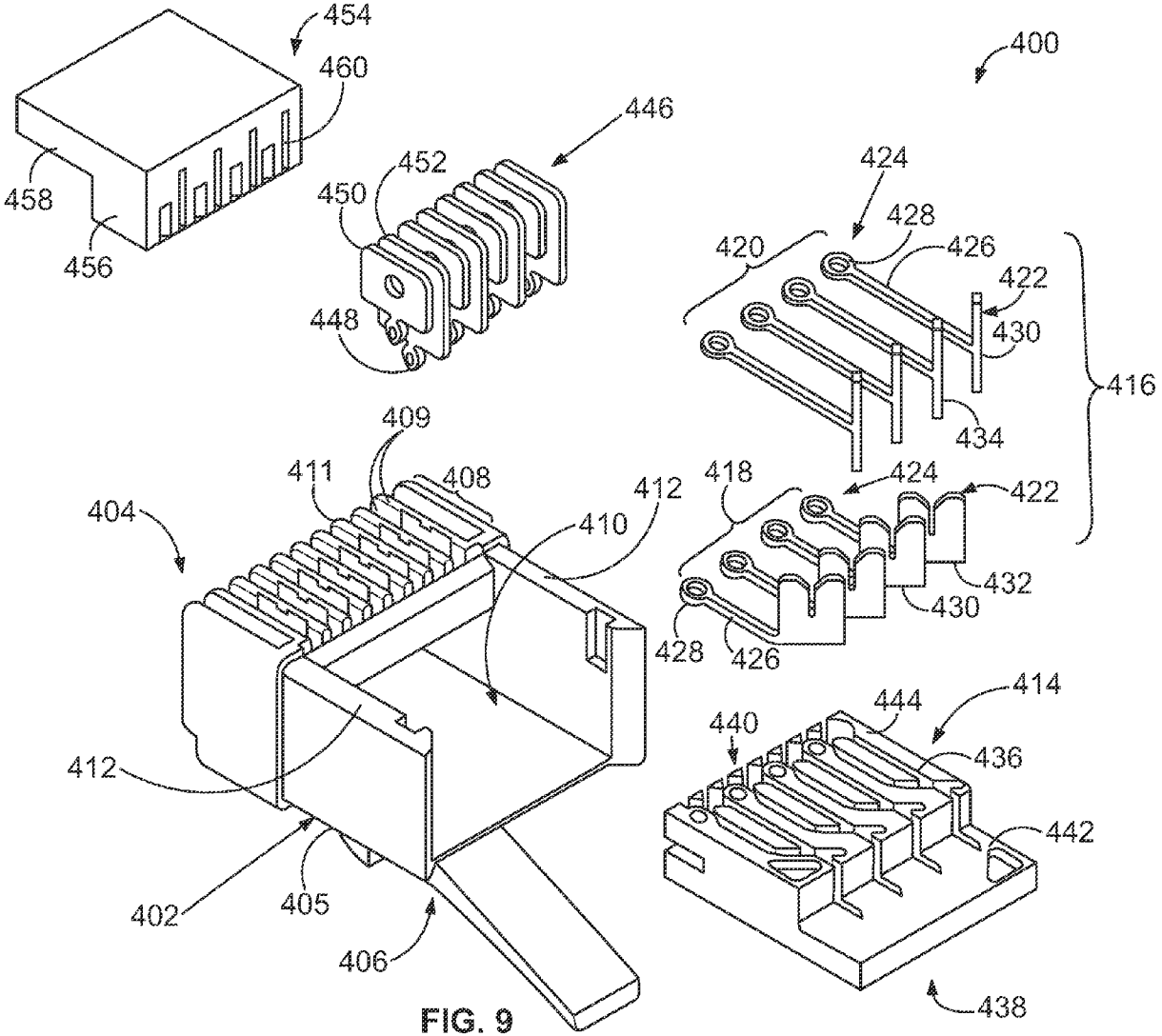
FIG. 9 is an exploded view of an electrical connector formed in accordance with another embodiment.

FIG. 9 illustrates an electrical connector 400 formed in accordance with another embodiment. The connector 400 includes a housing 402 having a mating end 404 and a wire end 406. The housing 402 includes a bottom 405 extending between the mating end 404 and the wire end 406. A contact holder 408 is positioned proximate to the mating end 404 of the housing 402. The contact holder 408 includes slots 409 separated by partitions 411. A cavity 410 is positioned proximate to the wire end 406 of the housing 402. The cavity 410 is defined by sidewalls 412 of the housing 402. A terminal tray 414 is configured to be positioned within the cavity 410 of the housing 402. The terminal tray 414 is configured to receive terminals 416.

The terminals 416 include an array of first terminals 418 and an array of second terminals 420. The terminals 416 each include a wire end 422 and a mating end 424. An arm 426 extends between the wire end 422 and the mating end 424. An aperture 428 is formed at the mating end 424 of each terminal 416. A wire contact 430 is joined to the wire end 422 of each terminal 416. The arm 426 of each terminal 416 extends between the aperture 428 and the wire contact 430. In an exemplary embodiment, the first terminals 148 include rear wire contacts 432 and the second terminals 420 include front wire contacts 434.

The terminals 416 are configured to be positioned within the terminal tray 414. The terminal tray 414 includes slots 436 that extend along the terminal tray 414. The slots 436 extend between a wire end 438 and a mating end 440 of the terminal tray 414. The slots 436 are aligned with and in communication with the slots 409 formed in the contact holder 408. The first terminals 418 are positioned within the slots 436 such that the rear wire contacts 432 are positioned on a rear mounting surface 442 of the terminal tray 414. The second terminals 420 are positioned within the slots 436 such that the front wire contacts 434 are positioned on a front mounting surface 444 of the terminal tray 414.

Mating contacts 446 are configured to be inserted into the slots 409 of the contact holder 408. The mating contacts 446 include connectors 448 that are received in the apertures 428 of the terminals 416. The connectors 448 are configured to be retained within the apertures 428 through an interference fit. For example, the connectors 448 may be eye-of-the-needle connectors that are press-fit into the apertures 428. In one embodiment, the mating contacts 446 may be soldered, welded, or otherwise adhered to the terminals 416. The mating contacts 446 include front mating contacts 450 and rear mating contacts 452. The front mating contacts 450 are joined to the second terminals 420. The rear mating contacts 452 are joined to the first terminals 418.

A retention housing 454 is configured to be positioned within the cavity 410 of the housing 402. The retention housing 454 includes a front portion 456 and a rear portion 458. The front portion 456 is configured to be positioned over the front mounting surface 444 of the terminal tray 414. The rear portion 222 is configured to be positioned over the rear mounting surface 442 of the terminal tray 414. The retention housing 454 includes slots 460 extending therethrough. The slots 460 are configured to be positioned over the terminals 416 when the retention housing 454 is positioned within the housing 402. The retention housing 454 holds the terminals 416 in position to provide stability to the terminals 416 within the terminal tray 414.

Figure 10:
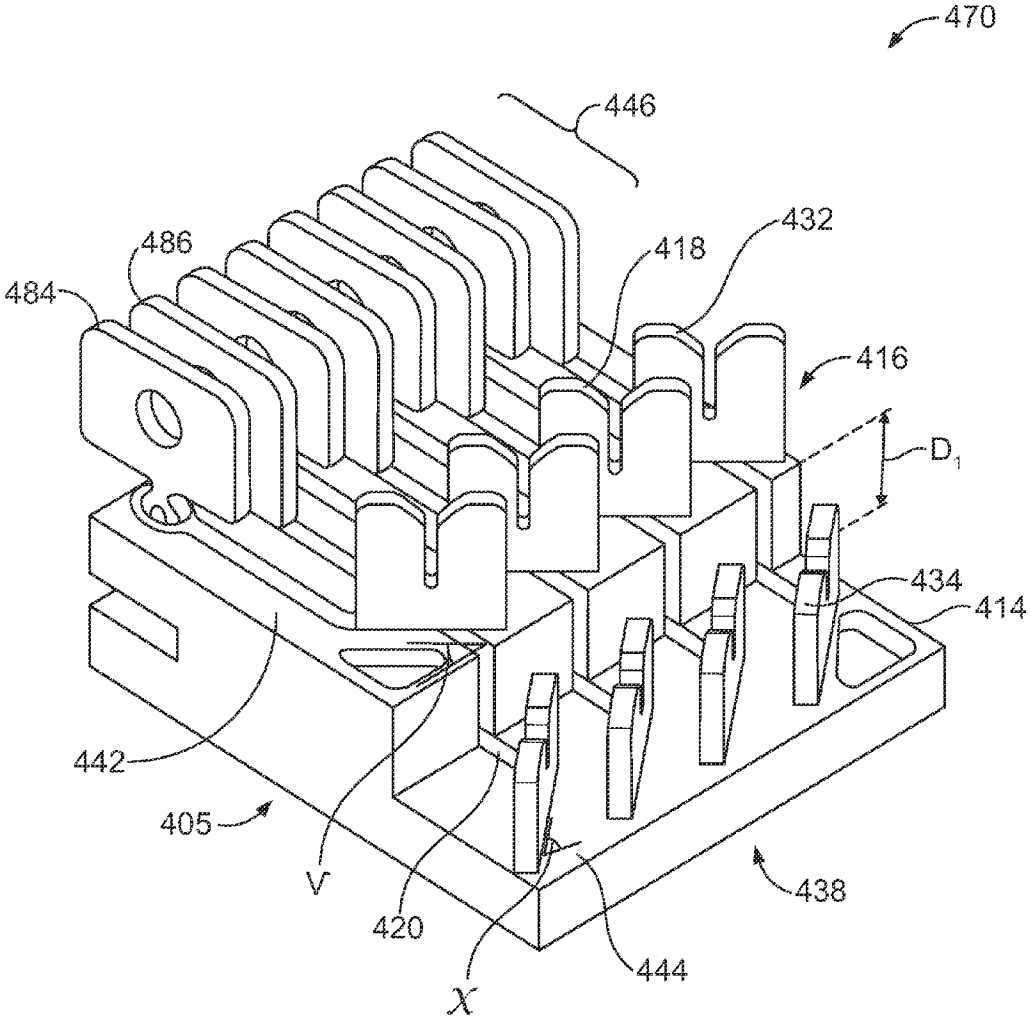
FIG. 10 is a top perspective view of an electrical assembly formed in accordance with an embodiment.

FIG. 10 illustrates an electrical assembly 470 formed in accordance with an embodiment. The electrical assembly 470 includes the terminal tray 414 and the terminals 416. The front mounting surface 444 of the terminal tray 414 is positioned closer to the wire end 438 of the terminal tray 414 than the rear mounting surface 442 of the terminal tray 414. The terminal tray 414 is configured to position within the housing 402 (shown in FIG. 9) such that the front mounting surface 444 is positioned proximate to the bottom 405 (shown in FIG. 9) of the housing 402 than the rear mounting surface 442. The rear mounting surface 442 is stepped up vertically a distance $D_1$ from the front mounting surface 444. The rear mounting surface 442 and the front mounting surface 444 are offset to provide a predetermined tuning for the connector 400. In an alternative embodiment, each of the front mounting surface 444 and the rear mounting surface 442 may be aligned within the same plane.

The front wire contacts 434 are positioned in the front mounting surface 444 and rear wire contacts 432 are positioned in the rear mounting surface 442. The front wire contacts 434 are configured to be positioned closer to the bottom 405 of the housing 402 than the rear wire contacts 432. The front wire contacts 434 are configured to be positioned closer to the wire end 438 of the terminal tray 414 than the rear wire contacts 432.

The front wire contacts 434 are arranged at an angle $\chi$ with respect to the wire end 438 of the terminal tray 414. In one embodiment, the angle $\chi$ may be 45 degrees. The rear wire contacts 432 are arranged at an angle $\upsilon$ with respect to the wire end 438 of the terminal tray 414. In one embodiment, the angle $\upsilon$ may be 45 degrees. The angle $\chi$ is opposite the angle $\upsilon$. In an exemplary embodiment, the front wire contacts 434 are arranged 90 degrees with respect to the rear wire contacts 432. In another embodiment, the front wire contacts 434 and the rear wire contacts 432 may be arranged at any angle with respect to one another. Optionally, the front wire contacts 434 may each be arranged at different angles $\chi$ and the rear wire contacts 432 may each be arranged at different angles $\upsilon$. The angles $\chi$ and $\upsilon$ are configured to provide predetermined tuning for the connector 400.

The mating contacts 446 are electrically coupled to the terminals 416. The mating contacts 446 include front mating contacts 484 and rear mating contacts 486. The front mating contacts 484 are electrically joined to the second terminals 420. The rear mating contacts 486 are electrically joined to the first terminals 418. The mating contacts 446 are arranged in parallel. In another embodiment, the mating contacts 446 may be offset from one another. The front mating contacts 484 are positioned adjacent to and alternate with the rear mating contacts 486. The front mating contacts 484 and the rear mating contacts 486 are alternated to achieve a predetermined tuning for the connector 400. In another embodiment, the front mating contacts 484 and the rear mating contacts 486 may be arranged in any order that provides a predetermined performance of the connector.

Figure 11:
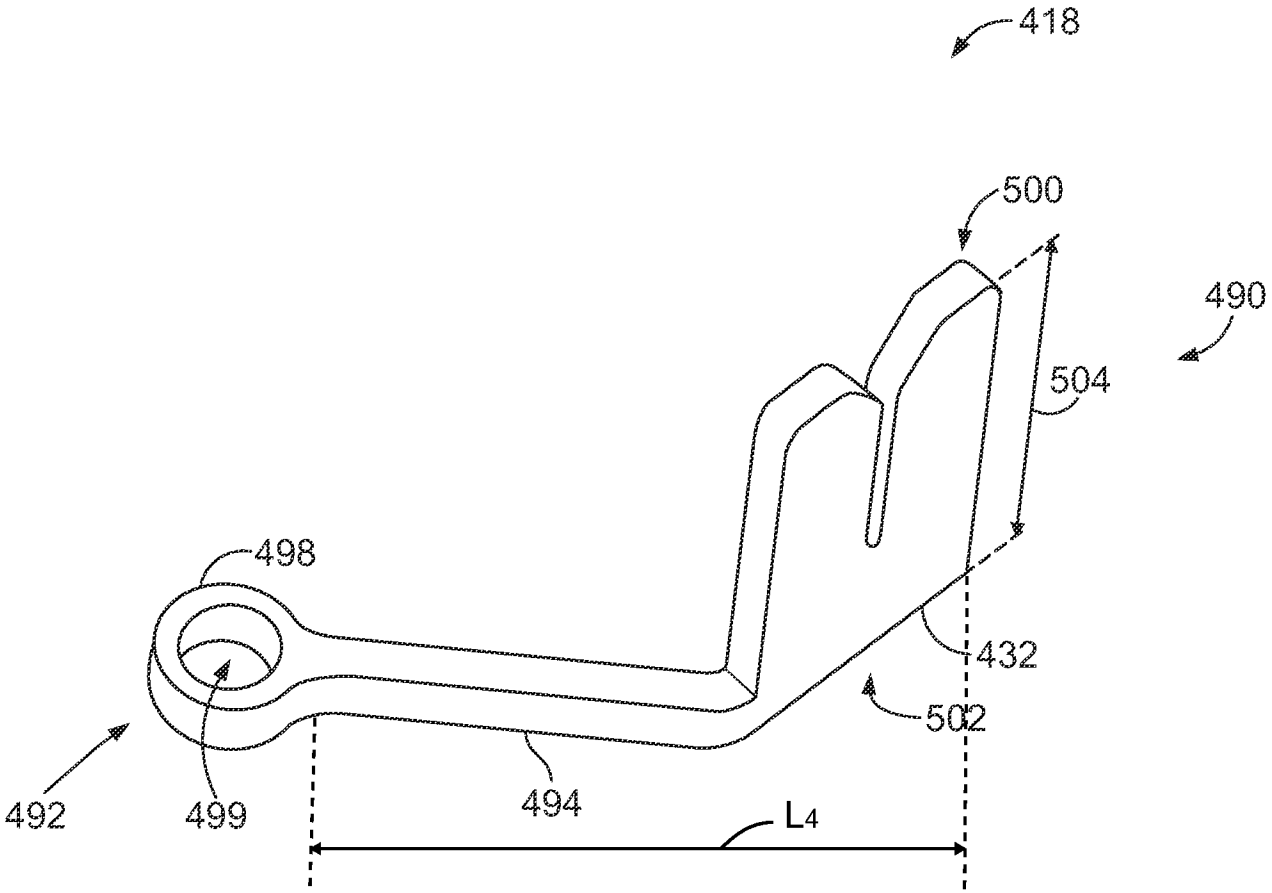
FIG. 11 is a side perspective view of a first terminal formed in accordance with another embodiment.

FIG. 11 illustrates a first terminal 418. The first terminal 418 includes a short wire end 490 and a short mating end 492. A short arm 494 extends between the short wire end 490 and the short mating end 492. The short arm 494 has a length $L_4$ defined between the short wire end 490 and the short mating end 492. A ring 498 is joined to the short mating end 492 of the first terminal 418. The ring 498 has an aperture 499 extending therethrough. The aperture 499 is configured to receive a rear mating contact 486. A rear wire contact 432 is joined to the short wire end 490 of the first terminal 418. The rear wire contact 432 has a top 500 and a bottom 502. The rear wire contact 432 has a height 504 defined between the top 500 and the bottom 502.

Figure 12:
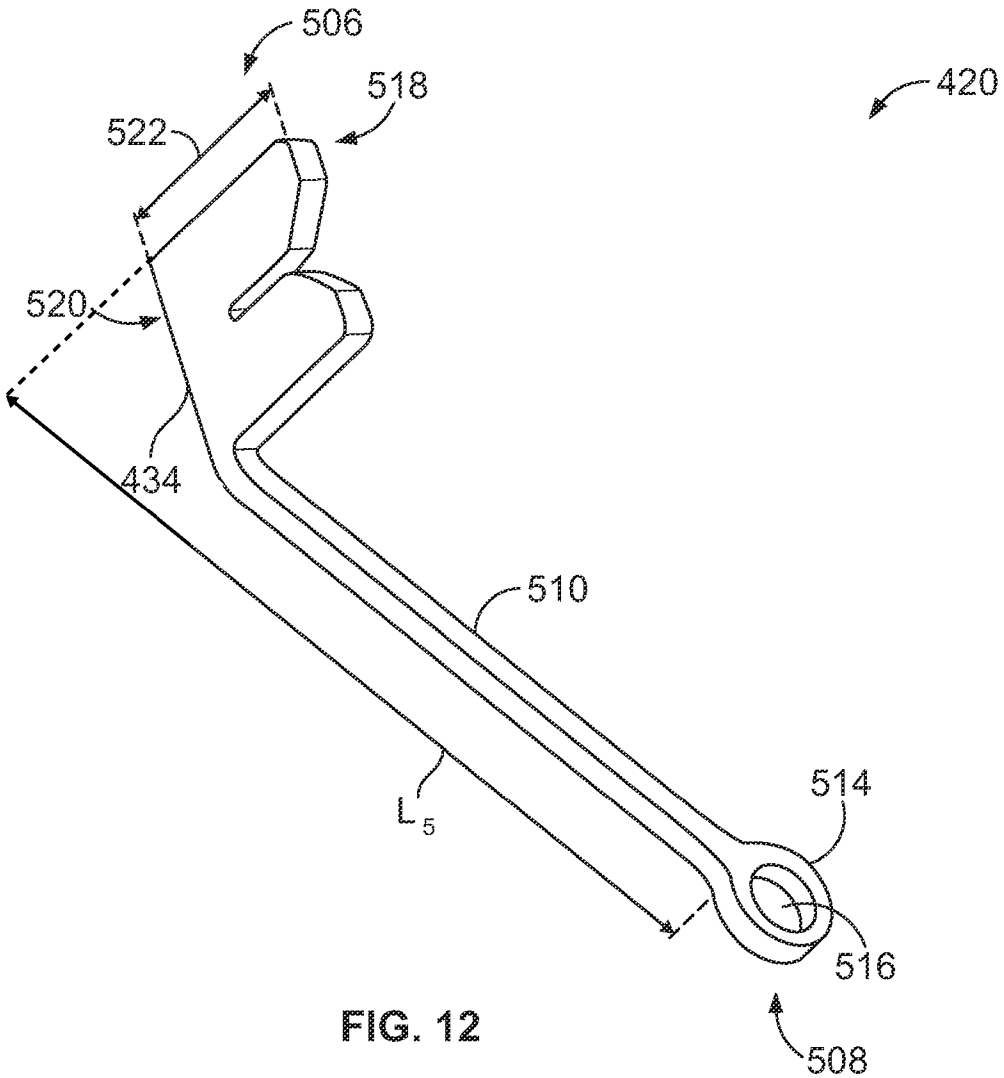
FIG. 12 is a side perspective view of a second terminal formed in accordance with another embodiment.

FIG. 12 illustrates a second terminal 420. The second terminal 420 includes a long wire end 506 and a long mating end 508. A long arm 510 extends between the long wire end 506 and the long mating end 508. The long arm 510 has a length $L_5$ defined between the long wire end 506 and the long mating end 508. The length $L_5$ of the long arm 510 is greater than the length $L_4$ of the short arm 494 (shown in FIG. 11). A ring 514 in joined to the long mating end 508 of the second terminal 420. The ring 514 has an aperture 516 extending therethrough. The aperture 516 is configured to receive a front mating contact 484.

A front wire contact 434 is joined to the long wire end 506 of the second terminal 420. The front wire contact 434 has a top 518 and a bottom 520. The front wire contact 434 has a height 522 defined between the top 518 and the bottom 520. The height 522 of the front wire contact 434 is equal to the height 504 of the rear wire contact 432 (shown in FIG. 11). Optionally, the height 522 of the front wire contact 434 may be less than or greater than the height 504 of the rear wire contact 432.

Figure 13:
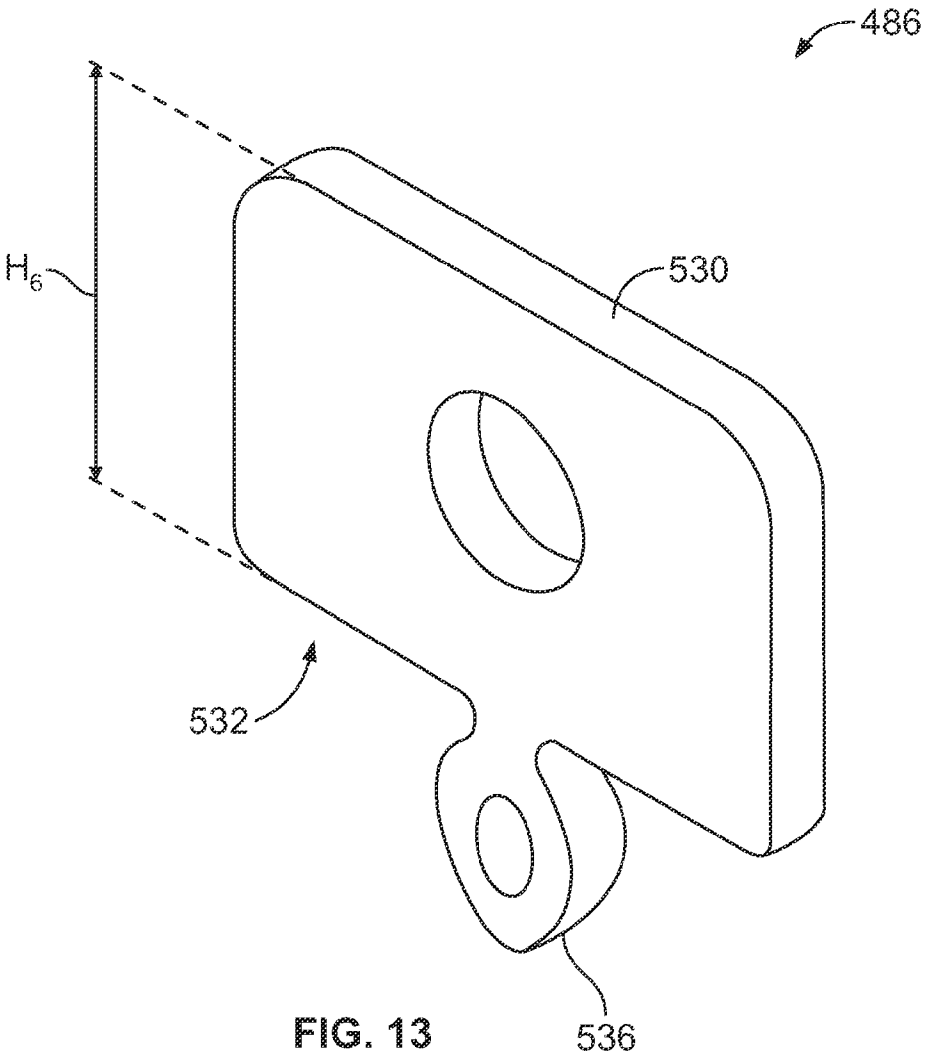
FIG. 13 is a side perspective view of a front mating contact formed in accordance with an embodiment.

FIG. 13 illustrates a rear mating contact 486. The rear mating contact 486 is configured to be joined to the short mating end 492 of the first terminal 418. The rear mating contact 486 includes a top 530 and a bottom 532. The rear mating contact 486 has a height $H_6$ defined between the top 530 and the bottom 532 of the rear mating contact 486. The bottom 532 of the rear mating contact 486 has a rear connector 536 extending therefrom. The rear connector 536 is configured as an eye-of-the-needle connector. The rear connector 536 is configured to be press-fit into the aperture 499 of the first terminal 418.

Figure 14:
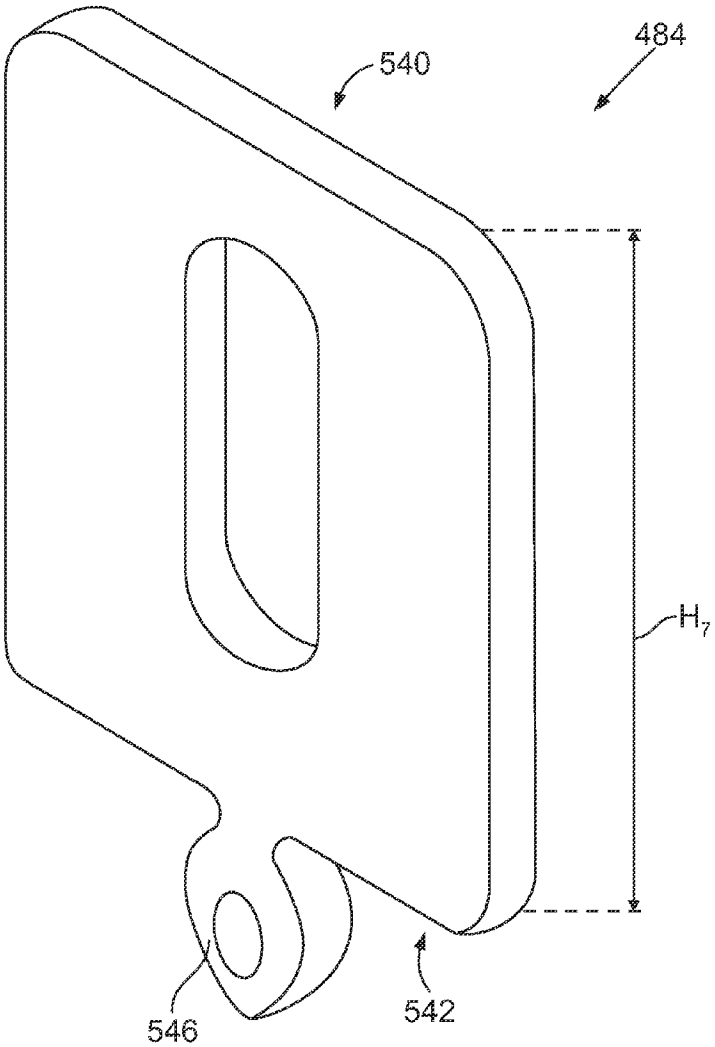
FIG. 14 is a side perspective view of a rear mating contact formed in accordance with an embodiment.

FIG. 14 illustrates a front mating contact 484. The front mating contact 484 is configured to be joined to the long mating end 508 of the second terminal 420. The front mating contact 484 has a top 540 and a bottom 542. The front mating contact 484 has a height $H_7$ defined between the top 540 and the bottom 542. The height $H_7$ of the front mating contact 484 is greater than the height $H_6$ of the rear mating contact 486 (shown in FIG. 13). Optionally, the height $H_7$ of the front mating contact 484 may be the same or less than the height $H_6$ of the rear mating contact 486. The bottom 542 of the front mating contact 484 has a front connector 546 extending therefrom. The front connector 546 is configured as an eye-of-the-needle connector. The front connector 546 is configured to be press-fit into the aperture 516 of the second terminal 420.

Figure 15:
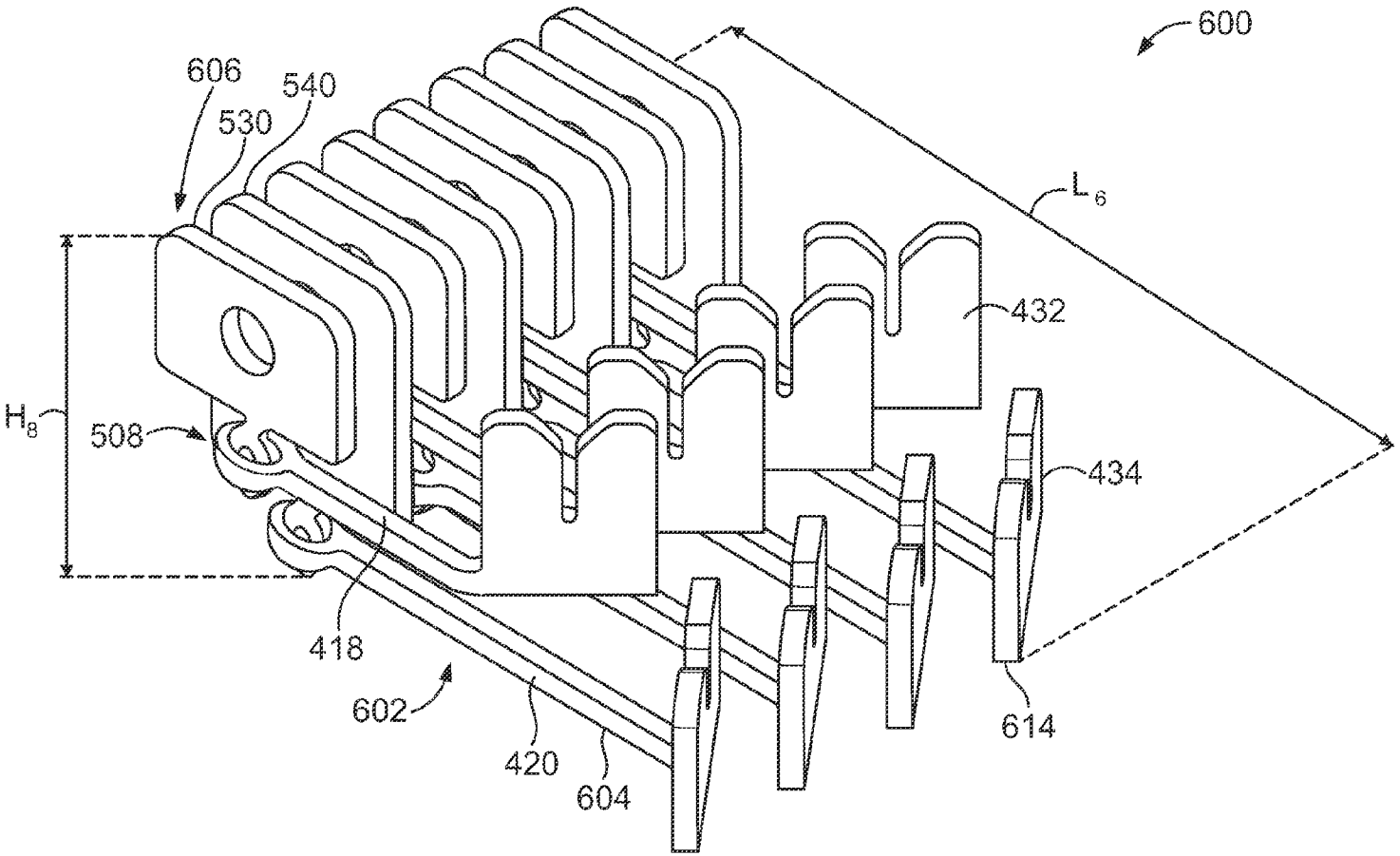
FIG. 15 is a top perspective view of a terminal array formed in accordance with another embodiment.

FIG. 15 illustrates a terminal array 600 formed in accordance with another embodiment. The terminal array 600 includes the second terminals 420 and first terminals 418. The terminal array 600 includes a bottom 602 defined by a bottom 604 of the second terminal 420. The terminal array 600 includes a top 606 defined by the tops 530, 540 of the mating contacts 446. The terminal array 600 has a height $H_8$ defined between the top 608 and the bottom 602. The terminal array 600 has a length $L_6$ defined between a long mating end 508 of the second terminal 420 and an end 614 of the front wire contact 434.

The second terminal 420 and the first terminal 418 are offset with respect to the height $H_8$ of the terminal array 600. The rear wire contact 432 and the front wire contact 434 are offset with respect to the height $H_8$ of the terminal array 600. The rear wire contact 432 and the front wire contact 434 are offset with respect to the length $L_6$ of the terminal array 600. The mating contacts 446 are aligned within the terminal array 600. Optionally, the mating contacts 446 may be offset with respect to the length $L_6$ of the terminal array 600.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the various embodiments of the invention without departing from their scope. While the dimensions and types of materials described herein are intended to define the parameters of the various embodiments of the invention, the embodiments are by no means limiting and are exemplary embodiments. Many other embodiments will be apparent to those of skill in the art upon reviewing the above description. The scope of the various embodiments of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. §112, sixth paragraph, unless and until such claim limitations expressly use the phrase "means for" followed by a statement of function void of further structure.

This written description uses examples to disclose the various embodiments of the invention, including the best mode, and also to enable any person skilled in the art to practice the various embodiments of the invention, including making and using any devices or systems and performing any incorporated methods. The patentable scope of the various embodiments of the invention is defined by the claims, and may include other examples that occur to those skilled in the art. Such other examples are intended to be within the scope of the claims if the examples have structural elements that do not differ from the literal language of the claims, or if the examples include equivalent structural elements with insubstantial differences from the literal languages of the claims.

The invention claimed is:

1. An electrical connector comprising:

a housing having a wire end and a mating end, the housing having a bottom extending between the wire end and the mating end and sidewalls extending from the wire end, the housing having slots extending between the wire end and the mating end, the slots each including an arm portion and a contact portion, arm portion extending parallel to the sidewalls, the contact portion extending non-orthogonally from the arm portion with respect to the wire end;

a terminal array extending between the wire end and the mating end of the housing, the terminal array having second terminals and first terminals, the second terminals and the first terminals having a wire end and a mating end and an arm extending between the wire end and mating end of the second terminals and the first terminals, each of the second and first terminals received in a corresponding one of the slots, the mating ends of the second terminals aligned with the mating ends of the first terminals, the wire ends of the second terminals positioned closer to the wire end of the housing than the wire ends of the first terminals, the arm received in the arm portion of the slot;

a wire contact positioned at the wire end of each of the second terminals and the first terminals, the wire contact received in the contact portion of the slot, the wire contact of each first terminal positioned a distance from the bottom of the housing, the wire contact of each second terminal positioned a distance from the bottom of the housing that is different than the distance of the wire contacts of the first terminals; and mating contacts positioned at the mating end of the second terminals and the first terminals, the mating contacts of the second terminals aligned and alternating with the mating contacts of the first terminals.

2. The electrical connector of claim 1, wherein the second terminal has a length that is greater than the first terminal.

3. The electrical connector of claim 1, wherein the second terminal has a height that is greater than the first terminal.

4. The electrical connector of claim 1, wherein the wire contacts are formed as blades, the wire contacts of the first terminal extending in a plane and the wire contacts of the second terminal extending in a plane that is non-parallel to the plane of the wire contacts of the first terminal.

5. The electrical connector of claim 1, wherein the wire contacts are configured to be joined to wires of a cable loaded to the housing, the wire contacts formed as blades that extend in a plane that is non-orthogonal to a loading direction of the cable.

6. The electrical connector of claim 1, wherein the mating contacts of the second terminals have a height that is different than a height of the mating contacts of the first terminals.

7. The electrical connector of claim 1, wherein the arm portions of adjacent slots extend parallel to each other, the arm portions of the slots receiving the second terminals having a length that is greater than a length of the arm portions of the slots receiving the first terminals.

8. The electrical connector of claim 1 further comprising an insert positioned within the housing, the insert having a wire end positioned proximate to the wire end of the housing and a mating end positioned proximate to the mating end of the housing, the insert including the slots.

9. The electrical connector of claim 1, wherein a mating contact is joined to the mating end of each second terminal and first terminal through an interference fit.

10. The electrical connector of claim 1, wherein the second and first terminals are configured to be received in alternating slots to achieve a predetermined tuning.

11. A terminal array for an electrical connector, the terminal array having a length and a height, the terminal array having second terminals and first terminals, each of the second terminals and the first terminals having a wire contact at a wire end and a mating contact at a mating end with an arm extending between the wire end and the mating end, the arm of each of the second terminals and first terminals being planar and extending parallel to the arms of adjacent terminals, the wire contacts being non-planar with the corresponding arms and extending non-orthogonally from the corresponding arms, the wire contact of each second terminal offset from wire contact of each first terminal along the length of the terminal array, the wire contact of each second terminal offset from the wire contact of each first terminal along the height of the terminal array.

12. The terminal array of claim 11, wherein the second terminal has a length that is greater than the first terminal.

13. The terminal array of claim 11, wherein the second terminal has a height that is greater than the first terminal.

14. The terminal array of claim 11, wherein the second terminals and the first terminals are configured to be retained within slots formed in a housing of an electrical connector.

15. The terminal array of claim 11, wherein the second terminals and the first terminals are configured to be retained within slots formed in an insert positioned in a housing of an electrical connector.

16. The terminal array of claim 11, wherein the mating contacts of the second terminals and the first terminals each have an aperture that receives a connector of the mating contact.

17. The terminal array of claim 11, wherein the wire contacts are formed as blades, the wire contacts of the first terminal extending in a plane and the wire contacts of the second terminal extending in a plane that is non-parallel to the plane of the wire contacts of the first terminal.

18. The terminal array of claim 13, wherein the wire contact of one of the first terminals crosses over the arm of an adjacent second terminal.

19. An electrical connector comprising:

a housing having a wire end and a mating end, a bottom extending between the wire end and the mating end; and a terminal array extending between the wire end and the mating end of the housing, the terminal array having second terminals and first terminals, the second terminals and the first terminals having a wire end, a mating end, and an arm extending therebetween, the arms each being planar and extending parallel to the arms of adjacent terminals, the mating ends of the second terminals aligned with the mating ends of the first terminals, the wire ends of the second terminals positioned closer to the wire end of the housing than the wire ends of the first terminals;

a wire contact positioned at the wire end of each of the second terminals and the first terminals, the wire contact of each of the second terminals and the first terminals being non-planar planar with the corresponding arm and extending non-orthogonally from the arm, the wire contact of each first terminal stepped up a distance from the wire contact of each second terminal with respect to the bottom of the housing; and mating contacts positioned at the mating end of the second terminals and the first terminals, the mating contacts of the second terminals aligned and alternating with the mating contacts of the first terminals.

20. The electrical connector of claim 19, wherein the second terminal has a length that is greater than the first terminal.

21. The electrical connector of claim 19, wherein the second terminal has a height that is greater than the first terminal.

22. The electrical connector of claim 19, wherein the wire contacts are formed as blades that extend in a plane that is non-orthogonal to the wire end of the housing.

23. The electrical connector of claim 19, wherein the wire contacts are formed as blades, the wire contacts of the first terminal extending in a plane and the wire contacts of the second terminal extending in a plane that is non-parallel to the plane of the wire contacts of the first terminal.

24. The electrical connector of claim 19, wherein the mating contacts of the second terminals have a height that is different than a height of the mating contacts of the first terminal.

25. The electrical connector of claim 19 further comprising an insert positioned within the housing, the insert having a wire end positioned proximate to the wire end of the housing and a mating end positioned proximate to the mating end of the housing, the insert including slots that between the wire end and the mating end of the insert, the slots retaining the terminal array.

26. The electrical connector of claim 19, wherein the mating contacts of the second terminals and first terminals extend a first direction from a plane defined by the arms, the wire contacts of the second terminals and first terminals also extending from the plane defined by the arms in the first direction.

* * * * *